US006004684A

United States Patent [19]

Sugg et al.

[11] Patent Number: 6,004,684

[45] **Date of Patent: *Dec. 21, 1999**

[54] ARTICLE HAVING A PROTECTIVE AND DECORATIVE MULTILAYER COATING

[75] Inventors: Rolin W. Sugg, Reading, Pa.; Richard P. Welty, Boulder, Colo.; Stephen R. Moysan, III, Douglasville, Pa.

[73] Assignee: Masco Corporation, Taylor, Mich.

[ * ] Notice: This patent is subject to a terminal disclaimer.

[21] Appl. No.: 08/846,750

[22] Filed: Apr. 30, 1997

[51] Int. Cl.[6] ..... B32B 15/04; B32B 15/00; C03C 27/02

[52] U.S. Cl. ..... 428/627; 428/628; 428/629; 428/632; 428/635; 428/660; 428/674; 428/680

[58] Field of Search ..... 428/627, 628, 428/629, 632, 635, 660, 674, 680

[56] References Cited

U.S. PATENT DOCUMENTS

| | | | |
|---|---|---|---|
| 2,316,303 | 4/1943 | Wesley et al. | 204/49 |
| 2,432,893 | 12/1947 | Holt | 204/43 |
| 2,653,128 | 9/1953 | Brenner | 204/43 |
| 2,926,124 | 2/1960 | Taylor | 204/43 |
| 3,090,733 | 5/1963 | Brown | 204/40 |
| 3,771,972 | 11/1973 | Schaer et al. | 29/196.6 |
| 3,772,168 | 11/1973 | Dillenberg | 204/43 S |
| 3,887,444 | 6/1975 | Fueki et al. | 204/43 S |
| 3,940,319 | 2/1976 | Pollack | 204/43 S |
| 4,029,556 | 6/1977 | Monaco et al. | 204/40 |
| 4,033,835 | 7/1977 | Lerner et al. | 204/435 S |
| 4,049,508 | 9/1977 | Morrissey | 204/435 S |
| 4,226,082 | 10/1980 | Nishida | 368/285 |
| 4,252,862 | 2/1981 | Nishida | 428/457 |
| 4,418,125 | 11/1983 | Henricks | 428/639 |
| 4,507,189 | 3/1985 | Doi et al. | 204/192 N |
| 4,556,607 | 12/1985 | Sastri | 428/627 |
| 4,591,418 | 5/1986 | Snyder | 204/192 P |
| 4,632,857 | 12/1986 | Mallory, Jr. | 428/209 |
| 4,640,869 | 2/1987 | Loth | 428/469 |
| 4,699,850 | 10/1987 | Kishi et al. | 428/469 |
| 4,761,346 | 8/1988 | Naik | 428/627 |

(List continued on next page.)

FOREIGN PATENT DOCUMENTS

| | | |
|---|---|---|
| 56-166063 | 12/1981 | Japan . |
| 59-9189 | 1/1984 | Japan . |

OTHER PUBLICATIONS

Electroplating, Frederick A. Lowenheim, pp. 210–225 (Admitted Prior Art).

Modern Electroplating, Frederick A. Lowenheim, The Electrochemical Society, Inc., NY, 1942, pp. 279, 280.

*Primary Examiner*—Paul Thibodeau
*Assistant Examiner*—Holly C Rickman
*Attorney, Agent, or Firm*—Myron B. Kapustij; Lloyd D. Doigan

[57] ABSTRACT

An article is coated with a multi-layer coating comprising a nickel layer deposited on the surface of the article, a nickel-tungsten-boron layer deposited on the nickel layer, a refractory metal, preferably zirconium layer deposited on the nickel-tungsten-boron layer, a sandwich layer comprised of alternating layers of a refractory metal and of a refractory metal compound deposited on the refractory metal layer, a refractory metal compound layer, preferably zirconium nitride, deposited on the sandwich layer, and a layer comprised of a refractory metal oxide or the reaction products of a refractory metal, oxygen and nitrogen deposited on the refractory metal compound layer.

56 Claims, 1 Drawing Sheet

U.S. PATENT DOCUMENTS

| | | | |
|---|---|---|---|
| 4,791,017 | 12/1988 | Hofmann et al. | 428/216 |
| 4,847,445 | 7/1989 | Helderman et al. | 174/68.5 |
| 4,849,303 | 7/1989 | Graham et al. | 428/670 |
| 4,911,798 | 3/1990 | Abys et al. | 204/44 |
| 4,925,394 | 5/1990 | Hayashi et al. | 439/86 |
| 5,024,733 | 6/1991 | Abys et al. | 204/3 |
| 5,102,509 | 4/1992 | Albon et al. | 205/257 |
| 5,178,745 | 1/1993 | Abys et al. | 205/219 |
| 5,250,105 | 10/1993 | Gomes et al. | 106/1.11 |
| 5,314,608 | 5/1994 | Caballero | 205/238 |
| 5,413,874 | 5/1995 | Moysan, III et al. | 428/627 |
| 5,476,724 | 12/1995 | Moysan, III et al. | 428/627 |
| 5,478,659 | 12/1995 | Moysan, III et al. | 428/627 |
| 5,478,660 | 12/1995 | Moysan, III et al. | 428/627 |
| 5,482,788 | 1/1996 | Moysan, III et al. | 428/627 |
| 5,484,663 | 1/1996 | Moysan, III et al. | 428/627 |
| 5,552,233 | 9/1996 | Moysan, III et al. | 428/627 |
| 5,626,972 | 5/1997 | Moysan, III et al. | 428/627 |
| 5,639,564 | 6/1997 | Moysan, III et al. | 428/627 |
| 5,641,579 | 6/1997 | Moysan, III et al. | 428/627 |
| 5,648,179 | 7/1997 | Moysan, III et al. | 428/627 |
| 5,654,108 | 8/1997 | Moysan, III et al. | 428/627 |
| 5,667,904 | 9/1997 | Moysan, III et al. | 428/627 |

ARTICLE HAVING A PROTECTIVE AND DECORATIVE MULTILAYER COATING

FIELD OF THE INVENTION

This invention relates to substrates, in particular brass substrates, coated with a multi-layer decorative and protective coating.

BACKGROUND OF THE INVENTION

It is currently the practice with various brass articles such as lamps, trivets, candlesticks, door knobs, door handles, door escutcheons and the like to first buff and polish the surface of the article to a high gloss and to then apply a protective organic coating, such as one comprised of acrylics, urethanes, epoxies, and the like, onto this polished surface. While this system is generally quite satisfactory it has the drawback that the buffing and polishing operation, particularly if the article is of a complex shape, is labor intensive. Also, the known organic coatings are not always as durable as desired, particularly in outdoor applications where the articles they are exposed to the elements and ultraviolet radiation. It would, therefore, be quite advantageous if brass articles, or indeed other metallic articles, could be provided with a coating which gave the article the appearance of highly polished brass and also provided wear resistance and corrosion protection. The present invention provides such a coating.

SUMMARY OF THE INVENTION

The present invention is directed to a metallic substrate having a multi-layer coating disposed or deposited on its surface. More particularly, it is directed to a metallic substrate, particularly brass, having deposited on its surface multiple superposed metallic layers of certain specific types of metals or metal compounds. The coating is decorative and also provides corrosion and wear resistance. The coating provides the appearance of highly polished brass, i.e. has a brass color tone. Thus, an article surface having the coating thereon simulates a highly polished brass surface.

A first layer deposited directly on the surface of the substrate is comprised of nickel. The first layer may be monolithic or it may consist of two different nickel layers such as a semi-bright nickel layer deposited directly on the surface of the substrate and a bright nickel layer superimposed over the semi-bright nickel layer. Disposed over the nickel layer is a layer comprised of nickel-tungsten-boron alloy. Over the nickel-tungsten-boron alloy layer is a layer comprised of a non-precious refractory metal such as zirconium, titanium, hafnium or tantalum, preferably zirconium or titanium. Over the refractory metal layer is a sandwich layer comprised of a plurality of alternating layer of a non-precious refractory metal, preferably zirconium or titanium, and a non-precious refractory metal compound such as zirconium compound, titanium compound, hafnium compound, or tantalum compound, preferably a zirconium compound or a titanium compound such as zirconium nitride or titanium nitride. Over the sandwich layer is a layer comprised of a non-precious refractory metal compound such as a zirconium compound or a titanium compound such as zirconium nitride or titanium nitride. In one embodiment a layer comprised of the reaction products of a non-precious refractory metal, preferably zirconium or titanium, oxygen and nitrogen is disposed over the non-precious refractory metal compound layer.

The nickel and nickel-tungsten-boron alloy layers are generally applied by electroplating. The non-precious refractory metal, refractory metal compound, and reaction products of refractory metal, oxygen and nitrogen layers are generally applied by vapor deposition processes such as sputter ion deposition.

DESCRIPTION OF THE PREFERRED EMBODIMENT

Figure 1:
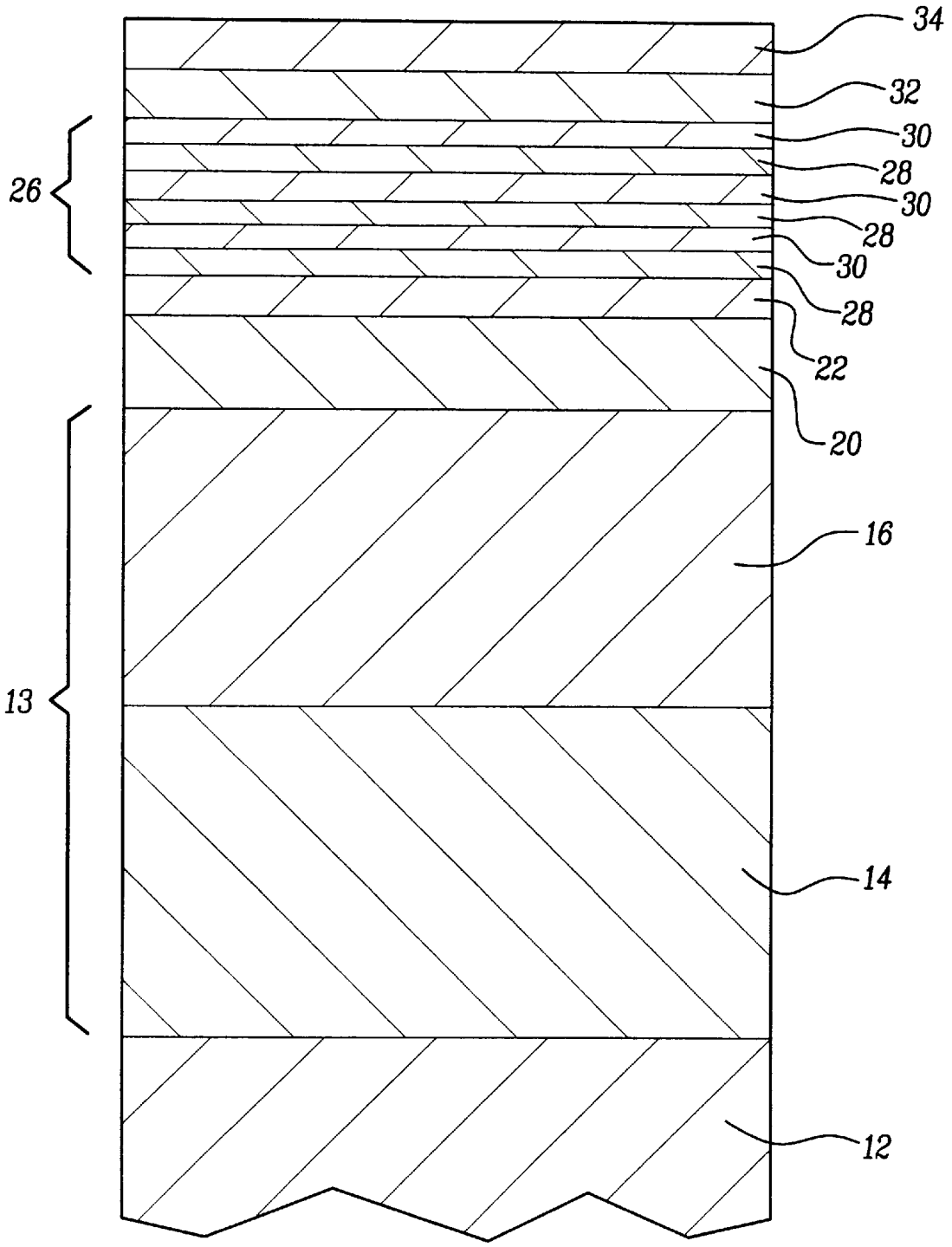
FIG. 1 is a cross-sectional view of a portion of the substrate having one embodiment of the multi-layer coating deposited on its surface.

The substrate 12 can be any platable metal or metallic alloy such as copper, steel, brass, tungsten, nickel alloys, and the like. In a preferred embodiment the substrate is brass.

The nickel layer 13 is deposited on the surface of the substrate 12 by conventional and well known electroplating processes. These processes include using a conventional electroplating bath such as, for example, a Watts bath as the plating solution. Typically such baths contain nickel sulfate, nickel chloride, and boric acid dissolved in water. All chloride, sulfamate and fluoroborate plating solutions can also be used. These baths can optionally include a number of well known and conventionally used compounds such as leveling agents, brighteners, and the like. To produce specularly bright nickel layer at least one brightener from class I and at least one brightener from class II is added to the plating solution. Class I brighteners are organic compounds which contain sulfur. Class II brighteners are organic compounds which do not contain sulfur. Class II brighteners can also cause leveling and, when added to the plating bath without the sulfur-containing class I brighteners, result in semi-bright nickel deposits. These class I brighteners include alkyl naphthalene and benzene sulfonic acids, the benzene and naphthalene di- and trisulfonic acids, benzene and naphthalene sulfonamides, and sulfonamides such as saccharin, vinyl and allyl sulfonamides and sulfonic acids. The class II brighteners generally are unsaturated organic materials such as, for example, acetylenic or ethylenic alcohols, ethoxylated and propoxylated acetylenic alcohols, coumarins, and aldehydes. These Class I and Class II brighteners are well known to those skilled in the art and are readily commercially available. They are described, inter alia, in U.S. Pat. No. 4,421,611 incorporated herein by reference.

The nickel layer can be a monolithic layer comprised of, for example, semi-bright nickel, bright nickel, or be a duplex layer containing a layer comprised of semi-bright nickel and a layer comprised of bright nickel. The thickness of the nickel layer is generally in the range of from about 100 millionths (0.000100) of an inch, preferably about 150 millionths (0.000150) of an inch to about 3,500 millionths (0.0035) of an inch.

As is well known in the art before the nickel layer is deposited on the substrate the substrate is subjected to said activation by being placed in a conventional and well known acid bath.

In one preferred embodiment as illustrated in the Figure, the nickel layer 13 is actually comprised of two different nickel layers 14 and 16. Layer 14 is comprised of semi-bright nickel while layer 16 is comprised of bright nickel. This duplex nickel deposit provides improved corrosion protection to the underlying substrate. The semi-bright, sulfur-free plate 14 is deposited, by conventional electroplating processes, directly on the surface of substrate 12. The substrate 12 containing the semi-bright nickel layer 14 is then placed in a bright nickel plating bath and the bright nickel layer 16 is deposited on the semi-bright nickel layer 14.

The thickness of the semi-bright nickel layer and the bright nickel layer is a thickness effective to provide improved corrosion protection. Generally, the thickness of the semi-bright nickel layer is at least about 50 millionths (0.00005) of an inch, preferably at least about 100 millionths (0.0001) of an inch, and more preferably at least about 150 millionths (0.00015) of an inch. The upper thickness limit is generally not critical and is governed by secondary considerations such as cost. Generally, however, a thickness of about 1,500 millionths (0.0015) of an inch, preferably about 1,000 millionths (0.001) of an inch, and more preferably about 750 millionths (0.00075) of an inch should not be exceeded. The bright nickel layer 16 generally has a thickness of at least about 50 millionths (0.00005) of an inch, preferably at least about 125 millionths (0.000125) of an inch, and more preferably at least about 250 millionths (0.00025) of an inch. The upper thickness range of the bright nickel layer is not critical and is generally controlled by considerations such as cost. Generally, however, a thickness of about 2,500 millionths (0.0025) of an inch, preferably about 2,000 millionths (0.002) of an inch, and more preferably about 1,500 millionths (0.0015) of an inch should not be exceeded. The bright nickel layer 16 also functions as a leveling layer which tends to cover or fill in imperfections in the substrate.

Disposed on the bright nickel layer 16 is a layer 20 comprised of nickel-tungsten-boron alloy. More specifically, layer 20 is comprised of a substantially amorphous composite alloy of nickel, tungsten and boron, more specifically an amorphous composite alloy of nickel, tungsten and boron. Layer 20 is deposited on layer 16 by conventional electroplating processes. The plating bath is normally operated at a temperature of about 115° to 125° F. and a preferred pH range of about 8.2 to about 8.6. The well known soluble, preferably water soluble, salts of nickel, tungsten and boron are utilized in the plating bath or solution to provide concentrations of nickel, tungsten and boron.

The nickel-tungsten-boron alloy layer 20 serves, inter alia, to reduce the galvanic couple between the refractory metal such as zirconium, titanium, hafnium, or tantalum containing layers 22 and 24 and the nickel layer.

The nickel-tungsten-boron alloy layer generally is comprised of from about 50 to about 70 weight percent nickel, about 30 to 50 weight percent tungsten, and from about 0.05 to about 2.5 weight percent boron, preferably from about 55 to about 65 weight percent nickel, about 35 to about 45 weight percent tungsten, and from about 0.5 to about 2.0 weight percent boron, and more preferably from about 57.5 to about 62.5 weight percent nickel, about 37.5 to about 42.5 weight percent tungsten, and from about 0.75 to about 1.25 weight percent boron. The plating bath contains sufficient amounts of the soluble salts of nickel, tungsten and boron to provide a nickel-tungsten-boron alloy of the afore-described composition.

A nickel-tungsten-boron plating bath effective to provide a nickel-tungsten-boron alloy of which a composition is commercially available, such as the Amplate™ system from Amorphous Technologies International of Laguna Niguel, Calif. A typical nickel-tungsten-boron alloy contains about 59.5 weight percent nickel, about 39.5 weight percent tungsten, and about 1% boron. The nickel-tungsten-boron alloy is an amorphous/nano-crystalline composite alloy. Such an alloy layer is deposited by the AMPLATE plating process marketed by Amorphous Technologies International.

The thickness of the nickel-tungsten-boron alloy layer 20 is a thickness which is at least effective to reduce the galvanic coupling between the hafnium, tantalum, zirconium or titanium, preferably zirconium or titanium, and more preferably zirconium containing layers 22 and 24 and the nickel layer 16. Generally, this thickness is at least about 20 millionths (0.00002) of an inch, preferably at least about 50 millionths (0.00005) of an inch, and more preferably at least about 100 millionths (0.0001) of an inch. The upper thickness range is not critical and is generally dependent on economic considerations. Generally, a thickness of about 2,500 millionths (0.0025) of an inch, preferably about 2,000 millionths (0.002), and more preferably about 1,000 millionths (0.001) of an inch should not be exceeded.

Disposed over the nickel-tungsten-boron alloy layer 20 is a layer 22 comprised of a non-precious refractory metal such as hafnium, tantalum, zirconium or titanium, preferably zirconium or titanium, and more preferably zirconium.

Layer 22 is deposited on layer 20 by conventional and well known techniques such as vacuum coating, physical vapor deposition such as ion sputtering, and the like. Ion sputtering techniques and equipment are disclosed, inter alia, in T. Van Vorous, "Planar Magnetron Sputtering; A New Industrial Coating Technique", Solid State Technology, December 1976, pp 62–66; U. Kapacz and S. Schulz, "Industrial Application of Decorative Coatings—Principle and Advantages of the Sputter Ion Plating Process", Soc. Vac. Coat., Proc. 34th Arn. Techn. Conf., Philadelphia, U.S.A., 1991, 48–61; and U.S. Pat. Nos. 4,162,954, and 4,591,418, all of which are incorporated herein by reference.

Briefly, in the sputter ion deposition process the refractory metal such as titanium or zirconium target, which is the cathode, and the substrate are placed in a vacuum chamber. The air in the chamber is evacuated to produce vacuum conditions in the chamber. An inert gas, such as Argon, is introduced into the chamber. The gas particles are ionized and are accelerated to the target to dislodge titanium or zirconium atoms. The dislodged target material is then typically deposited as a coating film on the substrate.

Layer 22 has a thickness which is generally at least about 0.25 millionths (0.00000025) of an inch, preferably at least about 0.5 millionths (0.0000005) of an inch, and more preferably at least about one millionth (0.000001) of an inch. The upper thickness range is not critical and is generally dependent upon considerations such as cost. Generally, however, layer 22 should not be thicker than about 50 millionths (0.00005) of an inch, preferably about 15 millionths (0.000015) of an inch, and more preferably about 10 millionths (0.000010) of an inch.

In a preferred embodiment of the present invention layer 22 is comprised of titanium or zirconium, preferably zirconium, and is deposited by sputter ion plating.

Disposed over layer 22 is a sandwich layer 26 comprised of alternating layers 28 and 30 of a non-precious refractory metal compound and a non-precious refractory metal. Layer 26 generally has a thickness of from about 50 millionths (0.00005) of an inch to about one millionth (0.000001) of an inch, preferably from about 40 millionths (0.00004) of an inch to about two millionths (0.000002) of an inch, and more preferably from about 30 millionths (0.00003) of an inch to about three millionths (0.000003) of an inch.

The non-precious refractory metal compounds comprising layers 28 include a hafnium compound, a tantalum compound, a titanium compound or a zirconium compound, preferably a titanium compound or a zirconium compound, and more preferably a zirconium compound. These compounds are selected from nitrides, carbides and carbonitrides, with the nitrides being preferred. Thus, the titanium compound is selected from titanium nitride, titanium carbide and titanium carbonitride, with titanium nitride being preferred. The zirconium carbide and zirconium carbonitride, with zirconium nitride being preferred.

The nitride compounds are deposited by any of the conventional and well known reactive vacuum deposition processes including reactive ion sputtering. Reactive ion sputtering is generally similar to ion sputtering except that a gaseous material which reacts with the dislodged target material is introduced into the chamber. Thus, in the case where zirconium nitride comprises layers 28, the target is comprised of zirconium and nitrogen gas is the gaseous material introduced into the chamber.

Layers 28 generally have a thickness of at least about two hundredth of a millionth (0.00000002) of an inch, preferably at least about one tenth of a millionth (0.0000001) of an inch, and more preferably at least about five tenths of a millionth (0.0000005) of an inch. Generally, the layers 28 should not be thicker than about 25 millionths (0.000025) of an inch, preferably about 10 millionths (0.000010) of an inch, and more preferably about five millionths (0.000005) of an inch.

The layers 30 alternating in the sandwich layer 26 with the non-precious refractory metal compound layers 28 are comprised of a non-precious refractory metal such as described for layer 22. The preferred metals comprising layers 30 are titanium and zirconium.

Layers 30 are deposited by any of the conventional and well known vapor deposition processes such as sputter ion deposition or plating processes.

Layers 30 have a thickness of at least about two hundredths of a millionth (0.00000002) of an inch, preferably at least about one tenth of a millionths (0.0000001) of an inch, and more preferably at least about five tenths of a millionth (0.0000005) of an inch. Generally, layers 30 should not be thicker than about 25 millionths (0.000025) of an inch, more preferably about 10 millionths (0.00001) of an inch, and more preferably about five millionths (0.000005) of an inch.

The number of alternating layers of metal 30 and metal nitride 28 in sandwich layer 26 is generally an amount effective to reduce stress and improve chemical resistance. Generally this amount is from about 50 to about two alternating layers 28, 30, preferably from about 40 to about four layers 28, 30, and more preferably from about 30 to about six layers 28, 30.

The sandwich layer 26 comprised of multiple alternating layers 28 and 30 generally serves to , inter alia, reduce film stress, increase overall film hardness, improve chemical resistance, and realign the lattice to reduce pores and grain boundaries from extending through the entire film.

A preferred method of forming the sandwich layer 26 is by utilizing ion sputter plating to deposit a layer 30 of non-precious refractory metal such as zirconium or titanium followed by reactive ion sputter plating to deposit a layer 28 of non-precious refractory metal nitride such as zirconium nitride or titanium nitride.

Preferably the flow rate of nitrogen gas is varied (pulsed) during the ion sputter plating between zero (no nitrogen gas is introduced) to the introduction of nitrogen at a desired value to form multiple alternating layers 28, 30 of metal 30 and metal nitride 28 in the sandwich layer 26.

The thickness proportionment of layers 30 to 28 is at least about 20/80, preferably about 30/70, and more preferably about 40/60. Generally, it should not be above about 80/20, preferably about 70/30, and more preferably about 60/40.

Disposed over the sandwich layer 26 is a layer 32 comprised of a non-precious refractory metal compound, preferably a non-precious refractory metal nitride, carbonitride, or carbide, and more preferably a nitride.

Layer 32 is comprised of a hafnium compound, a tantalum compound, a titanium compound or a zirconium compound, preferably a titanium compound or a zirconium compound, and more preferably a zirconium compound. The titanium compound is selected from titanium nitride, titanium carbide, and titanium carbonitride, with titanium nitride being preferred. The zirconium compound is selected from zirconium nitride, zirconium carbonitride, and zirconium carbide, with zirconium nitride being preferred.

Layer 32 provides wear and abrasion resistance and the desired color or appearance, such as for example, of polished brass. Layer 32 is deposited on layer 26 by way of the well known and conventional plating or deposition processes such as vacuum coating, reactive sputter ion plating, and the like. The preferred method is reactive ion sputter plating.

Layer 32 has a thickness at least effective to provide abrasion resistance. Generally, this thickness is at least 2 millionths (0.000002) of an inch, preferably at least 4 millionths (0.000004) of an inch, and more preferably at least 6 millionths (0.000006) of an inch. The upper thickness range is generally not critical and is dependent upon considerations such as cost. Generally a thickness of about 30 millionths (0.00003) of an inch, preferably about 25 millionths (0.000025) of an inch, and more preferably about 20 millionths (0.000020) of an inch should not be exceeded.

Zirconium nitride is the preferred coating material as it most closely provides the appearance of polished brass. By controlling the amount of nitrogen gas introduced into the reaction vessel during reactive ion sputtering the color of the zirconium nitride can be made similar to that of brass of various hues.

In one embodiment of the invention a layer 34 comprised of the reaction products of a non-precious refractory metal, an oxygen containing gas such as oxygen, and nitrogen is deposited onto layer 32. The refractory metals that may be employed in the practice of this invention are those which are capable of forming both a metal oxide, metal nitride and metal oxy-nitride under suitable conditions, for example, reaction with gases such as oxygen and nitrogen. The metals may include tantalum, hafnium, zirconium and titanium, preferably titanium and zirconium, and more preferably zirconium.

The reaction products of the metal, oxygen containing gas such as oxygen, and nitrogen generally comprise the metal oxide, metal nitride, and metal oxy-nitride. Thus, for example, the reaction products of zirconium, oxygen and nitrogen comprise zirconium oxide, zirconium nitride and zirconium oxy-nitride.

Layer 34 can be deposited by well known and conventional deposition techniques, including sputtering of a pure metal target or a composite target of oxides, nitrides and/or metals, reactive evaporation, ion and ion assisted sputtering, ion plating, molecular beam epitang, chemical vapor deposition and deposition from organic precursors in the form of liquids. Preferably, however, the metal reaction products of this invention are deposited by reactive ion sputtering.

These metal oxides and metal nitrides, including zirconium oxide and zirconium nitride alloys, and their preparation and deposition are conventional and well known, and are disclosed inter alia, in U.S. Pat. No. 5,367,285, the disclosure of which is incorporated herein by reference.

In another embodiment instead of layer 34 being comprised of the reaction products of a refractory metal, oxygen and nitrogen it is comprised of non-precious refractory metal oxide. The refractory metal oxides of which layer 34 is comprised include, but are not limited to, hafnium oxide, tantalum oxide, zirconium oxide and titanium oxide, preferably titanium oxide and zirconium oxide, and more preferably zirconium oxide. These oxides and their preparation are conventional and well known.

The metal, oxygen and nitrogen reaction products or metal oxide containing layer 34 generally has a thickness at least effective to provide improved chemical resistance. Generally this thickness is at least about five hundredths of a millionth (0.00000005) of an inch, preferably at least about one tenth of a millionth (0.0000001) of an inch, and more preferably at least about 0.15 millionths (0.00000015) of an inch. Generally, the metal oxy-nitride layer should not be thicker than about five millionths (0.000005) of an inch, preferably about two millionths (0.000002) of an inch, and more preferably about one millionth (0.000001) of an inch.

In order that the invention may be more readily understood the following example is provided The example is illustrative and does not limit the invention thereto.

EXAMPLE 1

Brass door escutcheons are placed in a conventional soak cleaner bath containing the standard and well known soaps, detergents, defloculants and the like which is maintained at a pH of 8.9–9.2 and a temperature of 180–200° F. for 30 minutes. The brass escutcheons are then placed for six minutes in a conventional ultrasonic alkaline cleaner bath. The ultrasonic cleaner bath has a pH of 8.9–9.2, is maintained at a temperature of about 160–180° F., and contains the conventional and well known soaps, detergents, defloculants and the like. After the ultrasonic cleaning the escutcheons are rinsed and placed in a conventional alkaline electro cleaner bath for about two minutes. The electro cleaner bath contains an insoluble submerged steel anode, is maintained at a temperature of about 140–180° F., a pH of about 10.5–11.5, and contains standard and conventional detergents. The escutcheons are then rinsed twice and placed in a conventional acid activator bath for about one minute. The acid activator bath has a pH of about 2.0–3.0, is at an ambient temperature, and contains a sodium fluoride based acid salt. The escutcheons are then rinsed twice and placed in a semi-bright nickel plating bath for about 10 minutes. The semi-bright nickel bath is a conventional and well known bath which has a pH of about 4.2–4.6, is maintained at a temperature of about 130–150° F., contains $NiSO_4$, $NiCL_2$, boric acid, and brighteners. A semi-bright nickel layer of an average thickness of about 250 millionths of an inch (0.00025) is deposited on the surface of the escutcheon.

The escutcheons containing the layer of semi-bright nickel are then rinsed twice and placed in a bright nickel plating bath for about 24 minutes. The bright nickel bath is generally a conventional bath which is maintained at a temperature of about 130–150° F., a pH of about 4.0–4.8, contains $NiSO_4$, $NiCL_2$, boric acid, and brighteners. A bright nickel layer of an average thickness of about 750 millionths (0.00075) of an inch is deposited on the semi-bright nickel layer. The semi-bright and bright nickel plated escutcheons are rinsed three times and placed for about forty minutes in a nickel-tungsten-boron plating bath available from Amorphous Technologies International of California as the AMPLATE bath. The bath utilizes insoluble platinized titanium anode, is maintained at a temperature of about 115–125° F. and a pH of about 8.2–8.6. A nickel-tungsten-boron layer of an average thickness of about 400 millionths (0.0004) of an inch is deposited on the bright nickel layer. The nickel-tungsten-boron plated escutcheons are then rinsed twice.

The nickel-tungsten-boron alloy plated escutcheons are placed in a sputter ion plating vessel. This vessel is a stainless steel vacuum vessel marketed by Leybold A.G. of Germany. The vessel is generally a cylindrical enclosure containing a vacuum chamber which is adapted to be evacuated by means of pumps. A source of argon gas is connected to the chamber by an adjustable valve for varying the rate of flow of argon into the chamber. In addition, two sources of nitrogen gas are connected to the chamber by an adjustable valve for varying the rate of flow of nitrogen into the chamber.

Two pairs of magnetron-type target assemblies are mounted in a spaced apart relationship in the chamber and connected to negative outputs of variable D.C. power supplies. The targets constitute cathodes and the chamber wall is an anode common to the target cathodes. The target material comprises zirconium.

A substrate carrier which carries the substrates, i.e., escutcheons, is provided, e.g., it may be suspended from the top of the chamber, and is rotated by a variable speed motor to carry the substrates between each pair of magnetron target assemblies. The carrier is conductive and is electrically connected to the negative output of a variable D.C. power supply.

The plated escutcheons are mounted onto the substrate carrier in the sputter ion plating vessel. The vacuum chamber is evacuated to a pressure of about $5\times10^{-3}$ millibar and is heated to about 400° C. via a radiative electric resistance heater. The target material is sputter cleaned to remove contaminants from its surface. Sputter cleaning is carried out for about one half minute by applying power to the cathodes sufficient to achieve a current flow of about 18 amps and introducing argon gas at the rate of about 200 standard cubic centimeters per minute. A pressure of about $3\times10^{-3}$ millibars is maintained during sputter cleaning.

The escutcheons are then cleaned by a low pressure etch process. The low pressure etch process is carried on for about five minutes and involves applying a negative D.C. potential which increases over a one minute period from about 1200 to about 1400 volts to the escutcheons and applying D.C. power to the cathodes to achieve a current flow of about 3.6 amps. Argon gas is introduced at a rate which increases over a one minute period from about 800 to about 1000 standard cubic centimeters per minute, and the pressure is maintained at about $1.1\times10^{-2}$ millibars. The escutcheons are rotated between the magnetron target assemblies at a rate of one revolution per minute. The escutcheons are then subjected to a high pressure etch cleaning process for about 15 minutes. In the high pressure etch process argon gas is introduced into the vacuum chamber at a rate which increases over a 10 minute period from about 500 to 650 standard cubic centimeters per minute (i.e., at the beginning the flow rate is 500 sccm and after ten minutes the flow rate is 650 sccm and remains 650 sccm during the remainder of the high pressure etch process), the pressure is maintained at about $2\times10^{-1}$ millibars, and a negative potential which increases over a ten minute period from about 1400 to 2000 volts is applied to the escutcheons. The escutcheons are rotated between the magnetron target assemblies at about one revolution per minute. The pressure in the vessel is maintained at about $2\times10^{-1}$ millibar.

The escutcheons are then subjected to another low pressure etch cleaning process for about five minutes. During this low pressure etch cleaning process a negative potential of about 1400 volts is applied to the escutcheons, D.C. power is applied to the cathodes to achieve a current flow of about 2.6 amps, and argon gas is introduced into the vacuum chamber at a rate which increases over a five minute period from about 800 sccm (standard cubic centimeters per minute) to about 1000 sccm. The pressure is maintained at about $1.1\times10^{-2}$ millibar and the escutcheons are rotated at about one rpm.

The target material is again sputter cleaned for about one minute by applying power to the cathodes sufficient to achieve a current flow of about 18 amps, introducing argon gas at a rate of about 150 sccm, and maintaining a pressure of about $3\times10^{-3}$ millibars.

During the cleaning process shields are interposed between the escutcheons and the magnetron target assemblies to prevent deposition of the target material onto the escutcheons.

The shields are removed and a layer of zirconium having an average thickness of about three millionths (0.000003) of an inch is deposited on the nickel/tungsten/boron layer of the escutcheons during a four minute period. This sputter deposition process comprises applying D.C. power to the cathodes to achieve a current flow of about 18 amps, introducing argon gas into the vessel at about 450 sccm, maintaining the pressure in the vessel at about $6\times10^{-3}$ millibar, and rotating the escutcheons at about 0.7 revolutions per minute.

After the zirconium layer is deposited the sandwich layer of alternating zirconium nitride and zirconium layers is deposited onto the zirconium layer. Argon gas is introduced into the vacuum chamber at a rate of about 250 sccm. D.C. power is supplied to the cathodes to achieve a current flow of about 18 amps. A bias voltage of about 200 volts is applied to the substrates. Nitrogen gas is introduced at an initial rate of about 80 sccm. The flow of nitrogen is then reduced to zero or near zero. This pulsing of nitrogen is set to occur at about a 50% duty cycle. The pulsing continues for about 10 minutes resulting in a sandwich stack with about six layers of an average thickness of about one millionth (0.000001) of an inch each. The sandwich stack has an average thickness of about six millionths (0.000006) of an inch.

After the sandwich layer of alternating layers of zirconium nitride and zirconium is deposited a layer of zirconium nitride having an average thickness of about 10 millionths (0.00001) of an inch is deposited on the sandwich stack during a period of about 20 minutes. In this step the nitrogen is regulated to maintain a partial ion current of about 6.3×10–11 amps. The argon, dc power, and bias voltage are maintained as above.

Upon completion of the deposition of the zirconium nitride layer, a thin layer of the reaction products of zirconium, oxygen and nitrogen is deposited having an average thickness of about 0.25 millionths (0.00000025) of an inch during a period of about 30 seconds. In this step the introduction of argon is kept at about 250 sccm, the cathode current is kept at about 18 amps, the bias voltage is kept at about 200 volts and the nitrogen flow is set at about 80 sccm. Oxygen is introduced at a rate of about 20 sccm.

While certain embodiments of the invention have been described for purposes of illustration, it is to be understood that there may be various embodiments and modifications within the general scope of the invention.

We claim:

1. An article comprising a substrate comprised of a platable metal or metallic alloy having disposed on at least a portion of its surface a multi-layer coating comprising:

layer comprised of semi-bright nickel;

layer comprised of bright nickel;

layer comprised of a nickel-tungsten-boron alloy;

non-precious refractory metal layer comprised of zirconium or titanium;

sandwich layer comprised of a plurality of alternating layers of a zirconium compound or a titanium compound layer alternating with zirconium or titanium layer, with a zirconium compound layer or a titanium compound layer of said sandwich layer directly desposed on said non-precious refractory metal layer; and a layer comprised of a zirconium compound or a titanium compound.

2. The article of claim 1 wherein said layers comprised of zirconium or titanium are comprised of zirconium.

3. The article of claim 2 wherein said layers comprised of a zirconium compound or a titanium compound are comprised of zirconium compound.

4. The article of claim 3 wherein said zirconium compound is comprised of zirconium nitride.

5. The article of claim 1 wherein said substrate is comprised of brass.

6. An article comprising a substrate comprised of a platable metal or metallic alloy having on at least a portion of its surface a multi-layered coating comprising:

layer comprised of semi-bright nickel;

layer comprised of bright nickel;

layer comprised of a nickel-tungsten-boron alloy;

layer comprised of zirconium or titanium;

sandwich layer comprised of a plurality of alternating layers comprised of a zirconium compound or a titanium compound layer alternating with titanium or zirconium layer;

layer comprised of a zirconium compound or a titanium compound; and layer comprised of zirconium oxide or titanium oxide.

7. The article of claim 6 wherein said layers comprised of zirconium or titanium are comprised of zirconium.

8.The article of claim 7 wherein said layers comprised of a zirconium compound or a titanium compound are comprised of a zirconium compound.

9. The article of claim 8 wherein said zirconium compound is zirconium nitride.

10. The article of claim 9 wherein said substrate is brass.

11. The article of claim 6 wherein said substrate is brass.

12. An article comprising a substrate comprised of a platable metal or metallic alloy having on at least a portion of its surface a multi-layer coating comprising:

layer comprised of nickel;

layer comprised of a nickel-tungsten-boron alloy;

non-precious refractory metal layer comprised of zirconium or titanium;

sandwich layer comprised of a plurality of alternating layers of a zirconium compound or a titanium compound layer alternating with a zirconium or titanium layer, with a zirconium compound layer or a titanium compound layer of said sandwich layer directly disposed on said non-precious refractory metal layer; and layer comprised of a zirconium compound or a titanium compound.

13. The article of claim 12 wherein said layer comprised of nickel is comprised of bright nickel.

14. The article of claim 12 wherein said layers comprised of zirconium or titanium are comprised of zirconium.

15. The article of claim 14 wherein said layers comprised of a zirconium compound or a titanium compound are comprised of a zirconium compound.

16. The article of claim 15 wherein said zirconium compound is comprised of zirconium nitride.

17. The article of claim 16 wherein said substrate is comprised of brass.

18. The article of claim 12 wherein said substrate is comprised of brass.

19. An article comprising a substrate comprised of a platable metal or metallic alloy having on at least a portion of its surface a multi-layered coating comprising:

layer comprised of nickel;

layer comprised of a nickel-tungsten-boron alloy;

layer comprised of zirconium or titanium;

sandwich layer comprised of a plurality of alternating layers comprised of a zirconium compound or a titanium compound layer alternating with titanium or zirconium layer;

layer comprised of a zirconium compound or a titanium compound; and layer comprised of zirconium oxide or titanium oxide.

20. The article of claim 19 wherein said nickel layer is comprised of bright nickel.

21. The article of claim 20 wherein said layers comprised of zirconium or titanium are comprised of zirconium.

22. The article of claim 21 wherein said layers comprised of a zirconium compound or a titanium compound are comprised of a zirconium compound.

23. The article of claim 22 wherein said zirconium compound is zirconium nitride.

24. The article of claim 19 wherein said layers comprised of zirconium or titanium are comprised of zirconium.

25. The article of claim 24 wherein said layers comprised of a zirconium compound or a titanium compound are comprised of a zirconium compound.

26. The article of claim 25 wherein said zirconium compound is zirconium nitride.

27. The article of claim 26 wherein said substrate is brass.

28. The article of claim 19 wherein said substrate is brass.

29. An article comprising a substrate comprised of a platable metal or metallic alloy having disposed on at least a portion of its surface a multi-layer coating comprising:

layer comprised of semi-bright nickel;

layer comprised of bright nickel;

layer comprised of a nickel-tungsten-boron alloy;

layer comprised of zirconium or titanium;

sandwich layer comprised of a plurality of alternating layers comprised of a zirconium compound or a titanium compound layer alternating with zirconium or titanium layer;

layer comprised of a zirconium compound or a titanium compound; and layer comprised of reaction products of zirconium or titanium, oxygen containing gas, and nitrogen.

30. The article of claim 29 wherein said layers comprised of zirconium or titanium are comprised of zirconium.

31. The article of claim 30 wherein said layers comprised of a zirconium compound or a titanium compound are comprised of a zirconium compound.

32. The article of claim 31 wherein said zirconium compound is zirconium nitride.

33. The article of claim 32 wherein said layer comprised of reaction products of zirconium or titanium, oxygen containing gas, and nitrogen is comprised of reaction products of zirconium, oxygen containing gas, and nitrogen.

34. The article of claim 33 wherein said substrate is brass.

35. The article of claim 29 wherein said substrate is brass.

36. An article comprising a substrate comprised of a platable metal or metallic alloy having on at least a portion of its surface a multi-layer coating comprising:

first layer comprised of semi-bright nickel;

second layer comprised of bright nickel;

third layer comprised of a nickel-tungsten-boron alloy;

fourth layer comprised of zirconium or titanium;

fifth layer comprised of a sandwich layer comprised of a plurality of alternating layers comprised of a zirconium compound or a titanium compound layer alternating with titanium or zirconium layer;

sixth layer comprised of a zirconium compound or a titanium compound; and seventh layer comprised of reaction products of zirconium or titanium, oxygen and nitrogen.

37. The article of claim 36 wherein said layers comprised of zirconium or titanium are comprised of zirconium.

38. The article of claim 37 wherein said layers comprised of a zirconium compound or a titanium compound are comprised of a zirconium compound.

39. The article of claim 38 wherein said zirconium compound is zirconium nitride.

40. The article of claim 39 wherein said layer comprised of reaction products of zirconium or titanium, oxygen and nitrogen is comprised of reaction products of zirconium, oxygen and nitrogen.

41. The article of claim 40 wherein said substrate is brass.

42. The article of claim 36 wherein said substrate is brass.

43. An article comprising a substrate comprised of a platable metal or metallic alloy having on at least a portion of its surface a multi-layer coating comprising:

layer comprised of nickel;

layer comprised of a nickel-tungsten-boron alloy;

layer comprised of zirconium or titanium;

sandwich layer comprised of a plurality of alternating layers comprised of a zirconium compound or a titanium compound layer alternating with zirconium or titanium layer;

layer comprised of a zirconium compound or a titanium compound; and layer comprised of reaction products of zirconium or titanium, oxygen and nitrogen.

44. The article of claim 43 wherein said nickel layer is comprised of bright nickel.

45. The article of claim 44 wherein said layers comprised of zirconium or titanium are comprised of zirconium.

46. The article of claim 45 wherein said layers comprised of a zirconium compound or a titanium compound are comprised of a zirconium compound.

47. The article of claim 46 wherein said zirconium compound is zirconium nitride.

48. The article of claim 47 wherein said layer comprised of reaction products of zirconium or titanium, oxygen and nitrogen is comprised of reaction products of zirconium, oxygen and nitrogen.

49. The article of claim 48 wherein said substrate is brass.

50. The article of claim 43 wherein said substrate is brass.

51. An article comprising a substrate comprised of a platable metal or metallic alloy having on at least a portion of its surface a multi-layer coating comprising:

first layer comprised of nickel;

second layer comprised of a nickel-tungsten-boron alloy;

third layer comprised of zirconium or titanium;

fourth layer comprised of a sandwich layer comprised of a plurality of alternating layers of a zirconium compound or a titanium compound layer alternating with zirconium or titanium layer;

fifth layer comprised of a zirconium compound or a titanium compound; and sixth layer comprised of reaction products of zirconium or titanium, oxygen and nitrogen.

52. The article of claim 51 wherein said nickel layer is comprised of bright nickel.

53. The article of claim 52 wherein said layers comprised of zirconium or titanium are comprised of zirconium.

54. The article of claim 53 wherein said layers comprised of a zirconium compound or a titanium compound are comprised of a zirconium compound.

55. The article of claim 54 wherein said zirconium compound is zirconium nitride.

56. The article of claim 55 wherein said layer comprised of reaction products of zirconium or titanium, oxygen and nitrogen is comprised of reaction products of zirconium, oxygen and nitrogen.

* * * * *